US008277243B1

(12) United States Patent
Hernandez et al.

(10) Patent No.: US 8,277,243 B1
(45) Date of Patent: Oct. 2, 2012

(54) CONNECTOR POSITION ASSURANCE DEVICE

(75) Inventors: Marcelino Hernandez, Coahuila (MX); Pedro Yabur, Coahuila (MX)

(73) Assignee: Delphi Technologies, Inc., Troy, MI (US)

( * ) Notice: Subject to any disclaimer, the term of this patent is extended or adjusted under 35 U.S.C. 154(b) by 19 days.

(21) Appl. No.: 13/072,171

(22) Filed: Mar. 25, 2011

(51) Int. Cl.
*H01R 13/627* (2006.01)

(52) U.S. Cl. ..... 439/352; 439/489

(58) Field of Classification Search ..... 439/310, 439/352, 357, 488, 489, 595, 752
See application file for complete search history.

(56) References Cited

U.S. PATENT DOCUMENTS

| | | | | |
|---|---|---|---|---|
| 5,637,009 | A | 6/1997 | Tsuji et al. | |
| 5,947,763 | A * | 9/1999 | Alaksin | 439/489 |
| 6,234,826 | B1 * | 5/2001 | Wilber et al. | 439/352 |
| 6,261,116 | B1 * | 7/2001 | Ceru | 439/352 |
| 6,435,895 | B1 * | 8/2002 | Fink et al. | 439/352 |
| 7,326,074 | B1 * | 2/2008 | Lim et al. | 439/352 |
| 7,399,195 | B2 * | 7/2008 | Kim et al. | 439/352 |
| 7,470,138 | B1 * | 12/2008 | Chen et al. | 439/352 |
| 7,549,887 | B1 * | 6/2009 | Ng et al. | 439/352 |
| 7,682,180 | B2 * | 3/2010 | Brown et al. | 439/352 |
| 7,682,181 | B1 * | 3/2010 | Jones et al. | 439/352 |
| 2005/0208820 | A1 | 9/2005 | Sanuki | |

OTHER PUBLICATIONS

European Search Report dated May 31, 2012.

* cited by examiner

*Primary Examiner* — Thanh Tam Le
(74) *Attorney, Agent, or Firm* — Paul W. Thiede

(57) ABSTRACT

A connector assembly is provided, and includes a first connector, a second connector, and a CPA device. The first connector has a stopper feature, a first end and a second end that generally opposes the first end. The stopper feature has a recess provided therein and a stopper surface. The second connector is received by the first connector. The second connector includes a shroud that slides over the first end of the first connector in a first direction. The CPA device is slidingly engaged with the second end of the first connector in a second direction that is generally perpendicular to the first direction. The CPA device has a flexible arm that is selectively deformable. In a pre-stage position, the flexible arm abuts against the stopper surface to restrict relative movement of the CPA device in the second direction.

20 Claims, 9 Drawing Sheets

CONNECTOR POSITION ASSURANCE DEVICE

BACKGROUND OF THE INVENTION

The present invention relates to a connector assembly and more particularly to a connector assembly having a connector position assurance (CPA) device and mating connectors.

Electrical connector assemblies commonly include mating male and female connectors. One problem that may occur is that the male and female connectors sometimes inadvertently separate and disconnect from one another. Therefore, a CPA device is provided with the electrical connector assembly in an effort to prevent the male and female connectors from disconnecting from one another.

In one example, the female connector includes a flexible arm used to lock the male and female connector in place when connected. The CPA device is provided within the body of the female connector and locks the flexible arm in place, and is moveable within the female connector in a pre-stage position and a full-stage position. When in the pre-stage position the CPA device will allow for relative movement of the flexible arm of the female connector. When in the full-stage position, the CPA locks the flexible arm in place to reduce or prevent disconnection between the male and female connectors. The CPA device is provided with a mating detection feature is that used to generally prevent the CPA device from engaging into the full-stage position until a connection has been made between the male and female connectors.

During assembly of the electrical connector, the male connector is connected to the female connector in a first operation. The CPA device should remain in the pre-stage position after the first operation. In another subsequent operation, the CPA device is locked into the full-stage position. It is advantageous to lock the CPA device into the full-stage position in another operation because this allows for an operator to validate that a connection has been made between the male and female connectors.

One drawback of present CPA devices is that they are prone to locking into the full-stage position during the first operation as the male and female connectors are connected to one another. This is because the force exerted on the female connector during the first operation is in the same direction as the force exerted on the CPA device to lock the CPA device into the full-stage position.

SUMMARY OF THE INVENTION

The present invention provides a CPA device that is not susceptible to inadvertent locking into the full-stage position as the male and female connectors are being connected to one another. A connector assembly is provided having a first connector, a second connector and a CPA device. The first connector has a stopper feature, a first end and a second end that generally opposes the first end. The stopper feature has a recess provided therein and a stopper surface. The second connector is received by the first connector, and includes a shroud that slides over the first end of the first connector in a first direction. The connector position assurance (CPA) device is slidingly engaged with the second end of the first connector in a second direction that is generally perpendicular to the first direction. The CPA device has a flexible arm that is selectively deformable. The flexible arm abuts against the stopper surface to restrict relative movement of the CPA device in the second direction in a pre-stage position. The flexible arm located within the recess of the stopper feature in an intermediate position. The shroud is positioned to selectively contact the flexible arm in the first direction to urge the flexible arm from the pre-stage position into the intermediate position.

A method of connecting a first connector to a second connector using a CPA device is provided. The method includes providing the first connector, the second connector, and the CPA device. The first connector has a first end and a second end that generally opposes the first end, and a stopper feature. The second connector includes a shroud that slidingly engages over the first connector in a first direction towards the second end. First, the CPA device is slidingly engaged with the second end of the first connector in a second direction, and relative movement of the CPA device is restricted in the second direction. The flexible arm of the CPA device abuts against a stopper surface of the stopper feature to restrict relative movement in the second direction to position the CPA device into a pre-stage position. The second connector then slides over the first connector in the first direction. The flexible arm is contacted as the second connector is slid in the first direction. The flexible arm is then urged out of the pre-stage position and into an intermediate position. The intermediate position has the flexible arm located a recess located within the stopper feature.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
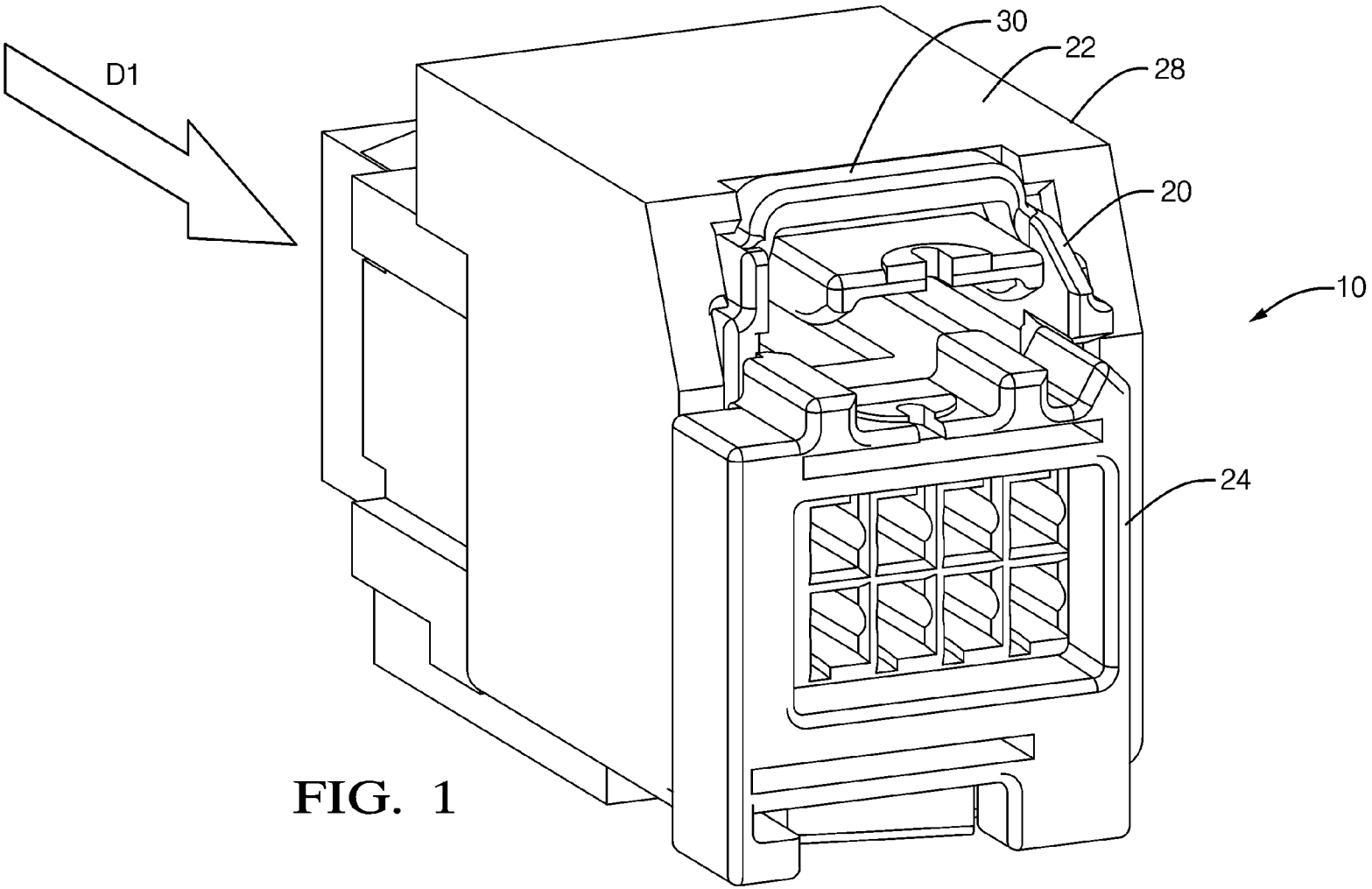
FIG. 1 is a perspective view of a connector assembly in accordance with one aspect of the invention.

Referring now to the Figures, where the invention will be described with reference to specific embodiments, without limiting same, FIG. 1 illustrates a connector assembly 10 in accordance with the present invention. In the exemplary embodiment as shown, the connector assembly 10 is an electrical connector assembly for carrying electrical, fiber optic, or other types of conductors. It will be appreciated that like elements are described with like numerals throughout this disclosure. Where alternative embodiments of like elements are shown, a prefix numeral may be added to distinguish the element from alternative embodiments.

Figure 2:
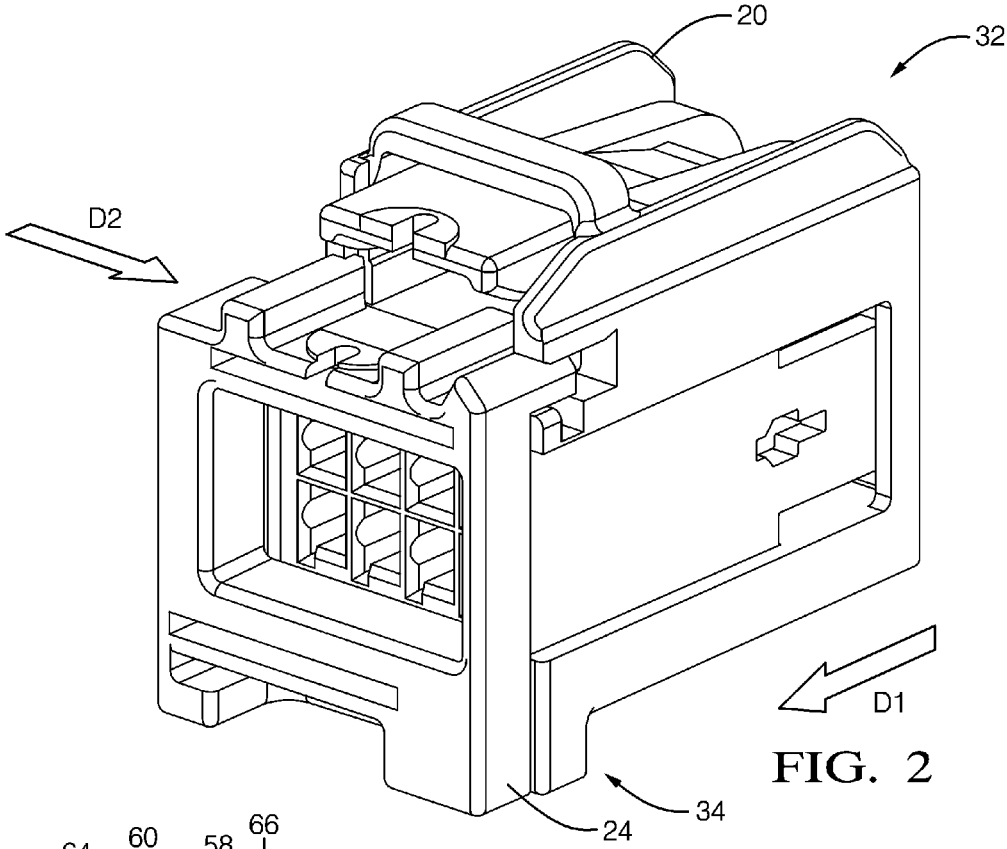
FIG. 2 is a perspective view of the first connector in a pre-stage position.

The connector assembly 10 includes a first connector 20, a second connector 22, and a connector position assurance (CPA) device 24. As shown in FIG. 1, the first connector 20 is a female connector and the second connector 22 is a male connector. The second connector 22 is received by the first connector 20. The second connector 22 includes a covering or shroud 28 that slides over an outer surface 30 of the first connector 20. Specifically, the shroud 28 slides over the first connector 20 in a first direction D1. Turning now to FIG. 2, an illustration of the first connector 20 and the CPA device 24 is shown. The first connector 20 includes a first end 32 and a second end 34. The CPA device is slidingly engaged with the second end 34 of the first connector 20 in a second direction D2. Referring to both FIGS. 1-2, the first direction D1 is generally perpendicular to the second direction D2. The shroud 28 is slid over the first connector 20 towards the second end 34 of the first connector 20.

Figure 3A:
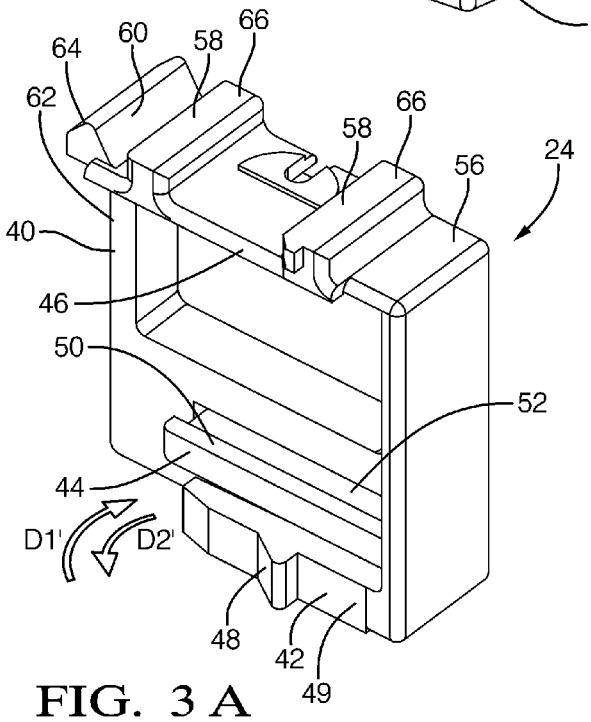
FIG. 3A is a perspective view of one aspect of the connector assembly shown in FIG. 1.
Figure 3B:
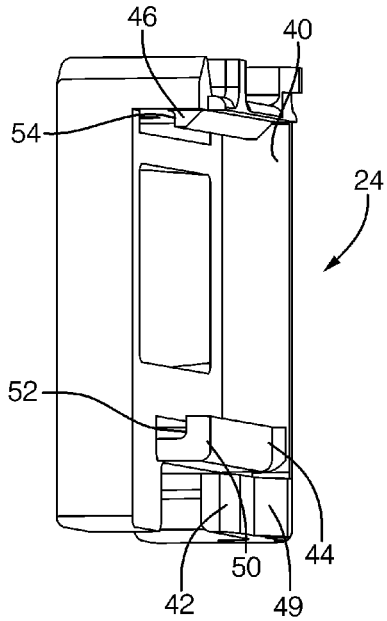
FIG. 3B is a perspective view of another aspect of the connector assembly shown in FIG. 1.

FIGS. 3A-3B illustrate a back side 40 of the CPA device 24. The back side 40 of the CPA device 24 includes a flexible arm 42, a rail 44 and a lip 46. Referring to FIG. 3A, the CPA device 42 is constructed from a material that allows for the flexible arm 42 to be deformable and flex back and forth in the directions D1' and D2' about a pivot point. In one non-limiting embodiment, the CPA device 42 is constructed from a polymer such as, for example, nylon. The flexible arm 42 includes a mating detection feature 48 located along an outer surface 49 of the flexible arm 42. In the embodiment as shown in FIGS. 3A-3B, the mating detection feature 48 is a raised surface or protuberance that projects from the outer surface 49. The rail 44 and the lip 46 are structural members that are used to slidingly engage the CPA device 24 with the first connector 20 in the second direction D2. In the non-limiting embodiment as shown, the rail 44 has an elongated raised portion 50 and an elongated cavity 52. The elongated cavity 52 is defined by the raised portion 50. FIG. 3B shows the lip 46 having an outer surface 54.

Referring specifically to FIG. 3A, a top surface 56 of the CPA device 24 includes a pair of raised projections 58 as well as a protuberance 60 that is positioned along a side edge 62 of the CPA device 24. The raised projections 58 each include a top surface 66. The protuberance 60 includes a chamfered edge 64.

Figure 4:
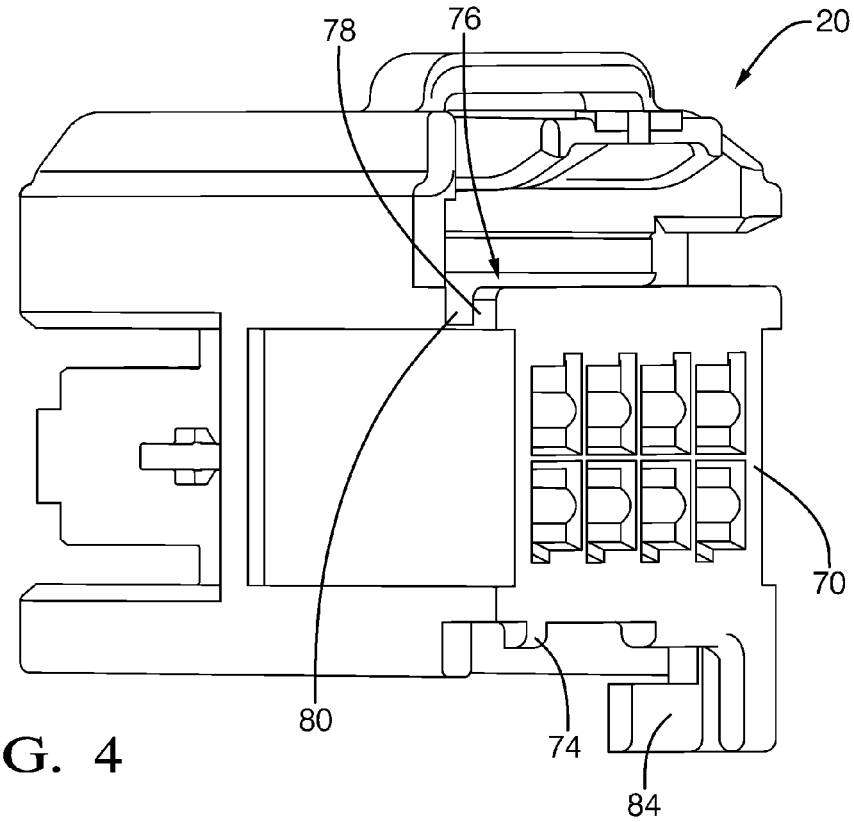
FIG. 4 is a perspective view of yet another aspect of the connector assembly in FIG. 1.

FIG. 4 is an illustration of a front side 70 of the first connector 20, where the front side 70 slidingly engages with the back side 40 of the CPA device 24. Referring to FIG. 3A-FIG. 4, the front side of the first connector 20 includes a guide 74 and a slot 76. The rail 44 of the CPA device 24 is configured to receive the guide 74, and the slot 76 is configured to receive the lip 46 of the CPA device 24 as the CPA device 24 is actuated with the first connector 20. Specifically, the cavity 52 of the rail 44 (FIG. 3A) receives the guide 74 of the first connector 20. The slot 76 of the first connector 20 has an elongated raised portion 78 and an elongated cavity 80 that is created by the raised portion 78. The cavity 80 of the slot 76 receives the lip 46 of the first connector 20. The engagement of the guide 74 with the rail 44 and the slot 76 with the lip 46 provides strength and stability to the connector assembly 10. Referring to FIG. 4, the front side 70 of the first connector 20 also includes a stopper feature 84. The stopper feature 84 is configured to selectively engage with the flexible arm 42 during assembly of the CPA device 24 to the first connector 20.

Figure 5A:
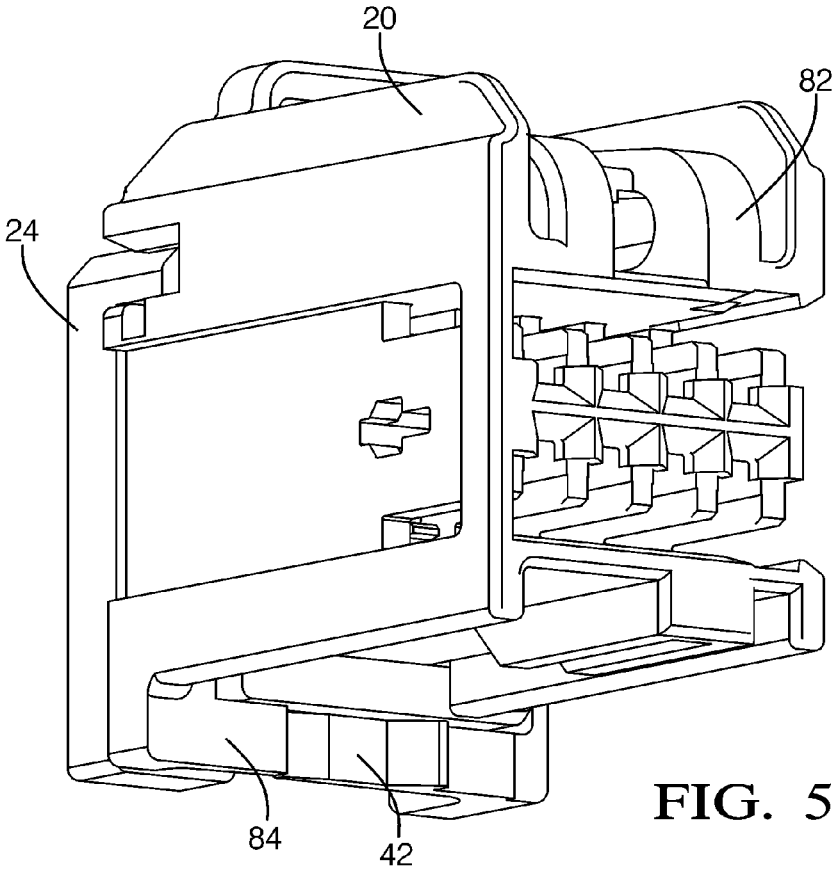
FIG. 5A is another perspective view of the connector assembly in the pre-stage position.
Figure 5B:
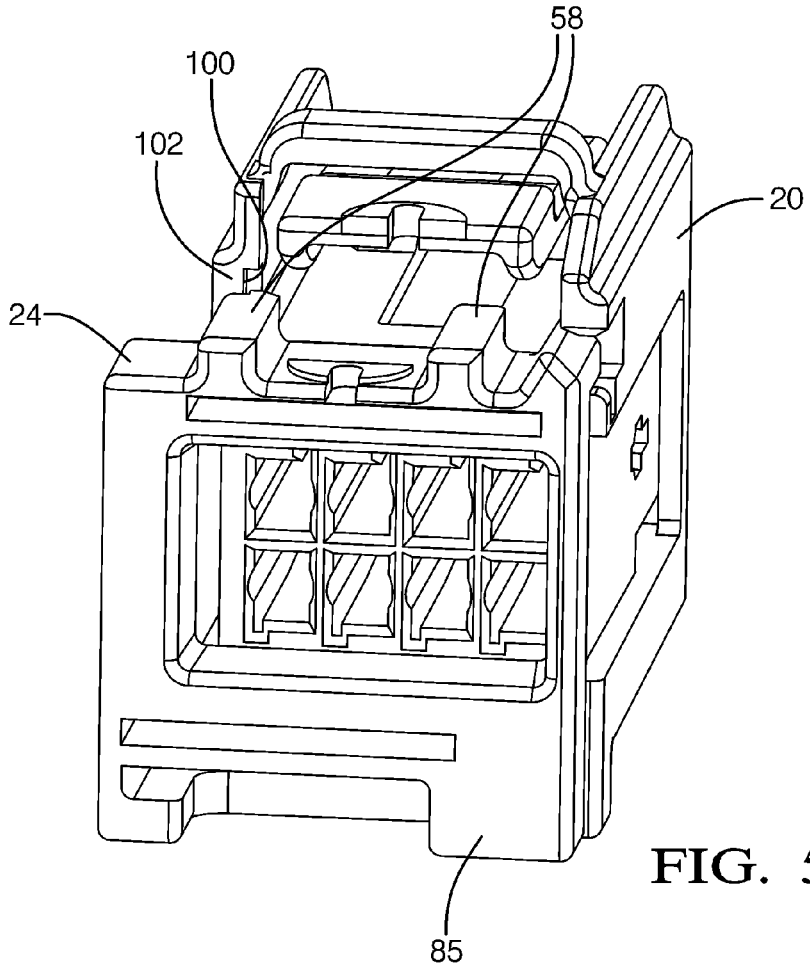
FIG. 5B is yet another perspective view of the connector assembly in the pre-stage position.
Figure 5C:
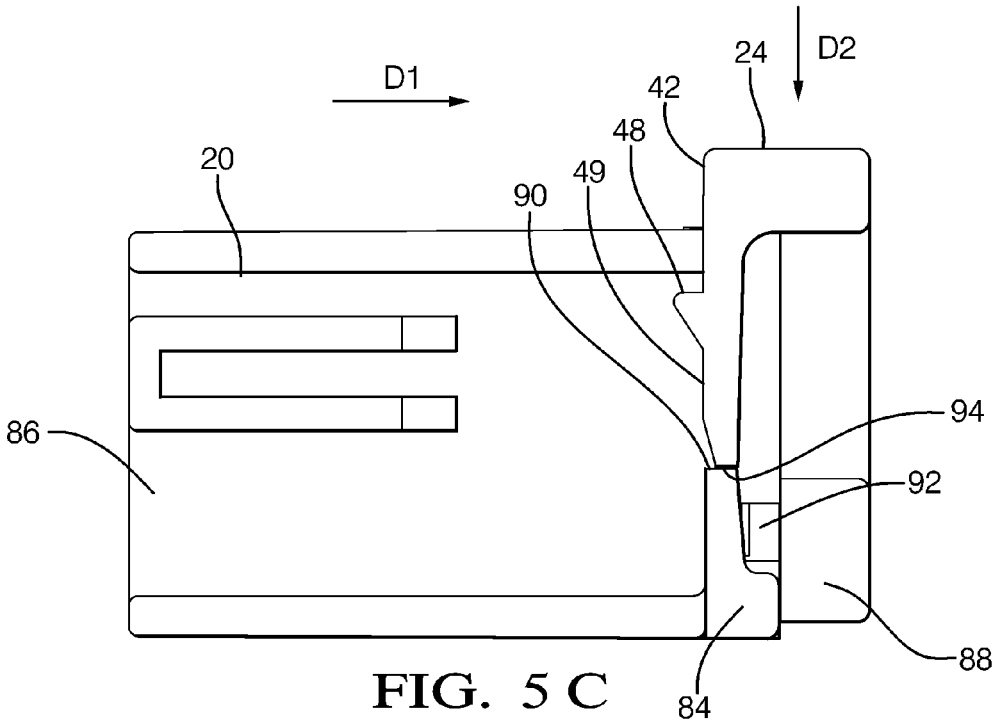
FIG. 5C is a bottom view of the connector assembly in the pre-stage position.

FIGS. 5A-5C illustrate the CPA device 24 slidingly engaged with the first connector 20. FIG. 5A is a perspective view taken along a back side 82 of the first connector 20. FIG. 5B is a perspective view taken along a front side 85 of the CPA device 24. FIG. 5C is an illustration of a bottom surface 86 of the first connector 20 and a bottom surface 88 of the CPA device 24. In the non-limiting embodiments as shown in FIGS. 5A-5C, the CPA device 24 is positioned in a pre-stage position. In the pre-stage position, the first connector 20 and the second connector 24 can mate and connect with one another.

Referring to FIG. 5A, the stopper feature 84 is engaged with the flexible arm 42 in the pre-stage position, thereby restricting relative movement of the CPA device 24 in the second direction D2. Specifically, referring to FIG. 5C, the stopper feature 84 has a stopper surface 90 and a recess 92. The outer surface 49 of the flexible arm 42 abuts against the stopper surface 90, thereby restricting movement of the CPA device 24 in the second direction D2. In the non-limiting embodiment as shown in FIG. 5C, the stopper surface 90 is generally parallel with a portion 94 of the outer surface 49 of the flexible arm 42. The stopper surface 90 abuts against the outer surface 49 of the flexible arm 42 to hold the CPA device 24 in the pre-stage position. The mating detection feature 48 of the flexible arm 42 is a raised protuberance configured to contact the shroud 28 during assembly of the first connector 20 to the second connector 22.

Figure 6A:
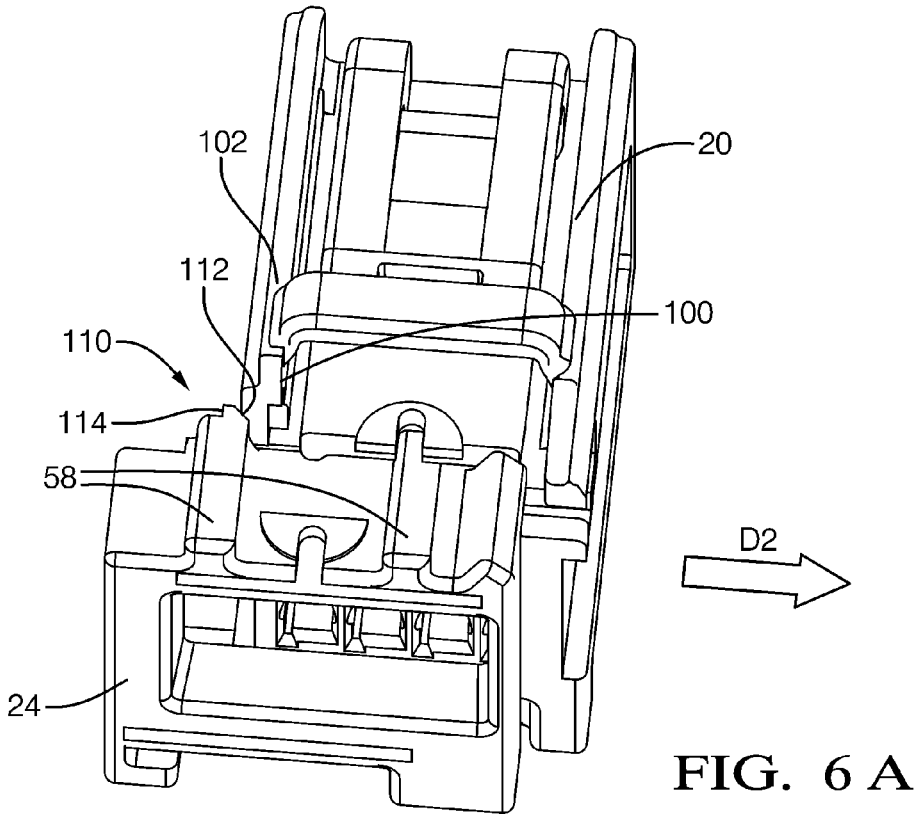
FIG. 6A is an enlarged top view of the connector assembly.
Figure 6B:
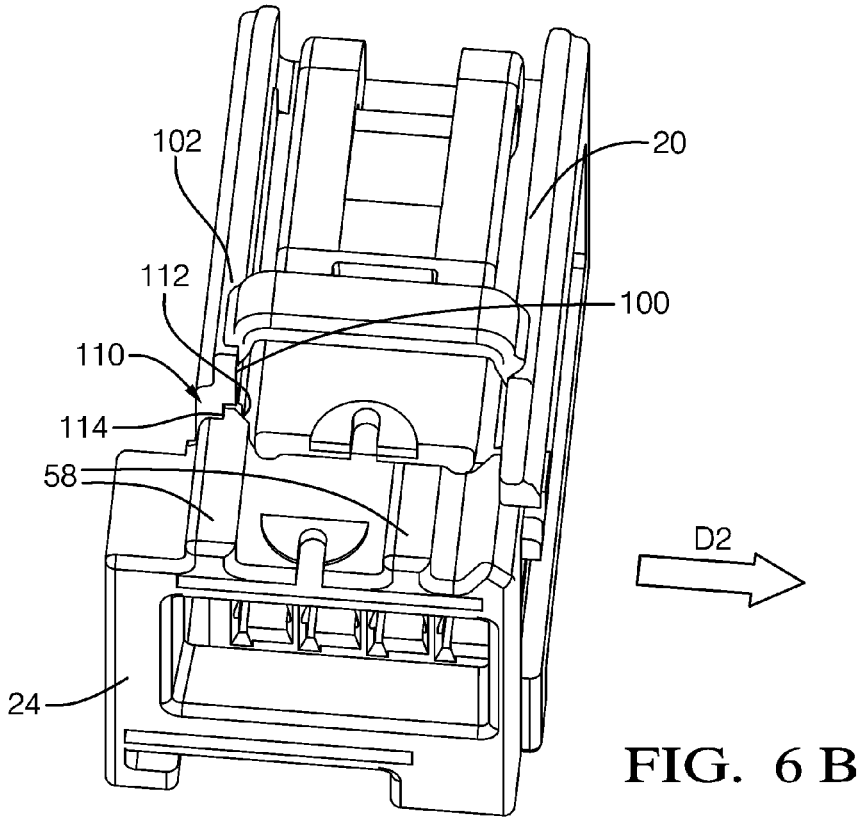
FIG. 6B is an enlarged view of the connector assembly in the pre-stage position.

Referring to FIG. 5B, one of the raised projections 58 of the CPA device 24 is engaged with an inner surface 100 of a wall 102 of the first connector 20. The engagement between the raised projection 58 and the inner surface 100 of the first connector 20 also secures the CPA device 24 in the pre-stage position. Turning now to FIGS. 6A-6B, an enlarged view of the engagement between one of the raised projections 58 and the first connector 20 is shown. FIG. 6A is an illustration of the CPA device 24 and the first connector 20 before the CPA device 24 is slid in the second direction D2 and into the pre-stage position. FIG. 6B is an illustration of the CPA device 24 and the first connector 20 in the pre-stage position.

Referring to FIG. 6A, at least one of the raised projections 58 include a tab 110. The tab 110 includes a chamfered edge 112 and an engagement surface 114. As the CPA device 24 is slid in the second direction D2, the tab 110 slightly elastically deforms and is pushed over the wall 102 of the first connector 20. The chamfered edge 112 facilitates the deformation of the tab 110 over the wall 102. FIG. 6B illustrates the engagement surface 114 of the tab 110 engaging the inner surface 110 of the wall 102 of the first connector 20. The engagement between the tab 110 and the inner surface 100 of the wall 102 positions the CPA device 24 in the pre-stage position.

Figure 7A:
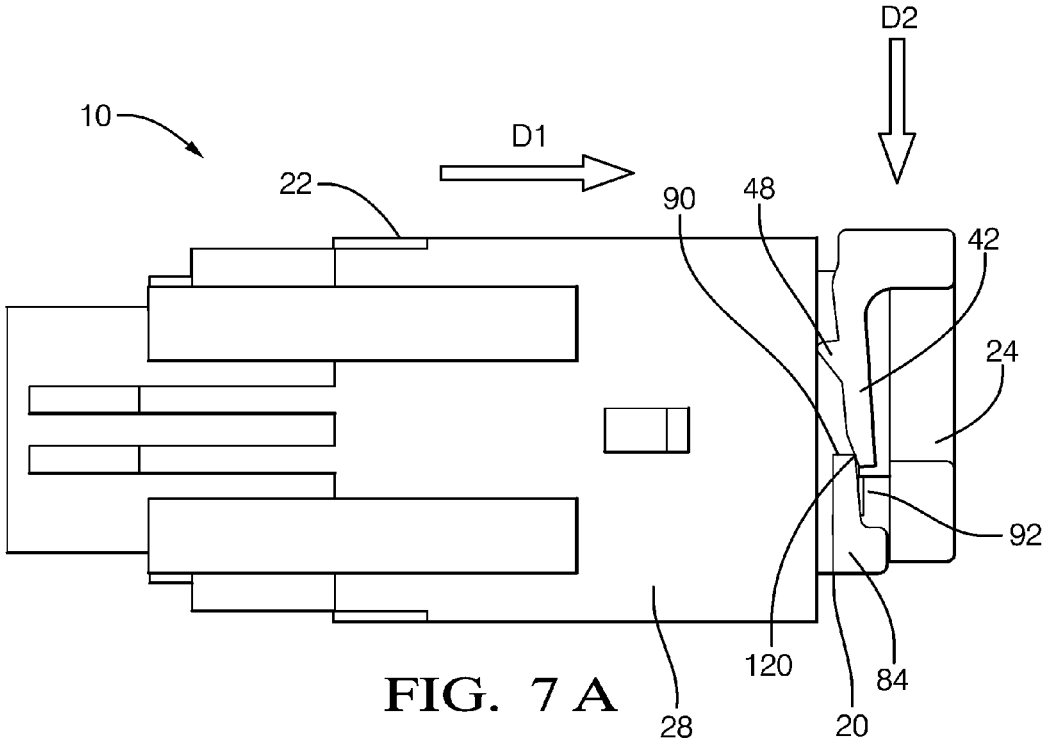
FIG. 7A is a bottom view of the connector assembly in an intermediate position.
Figure 7B:
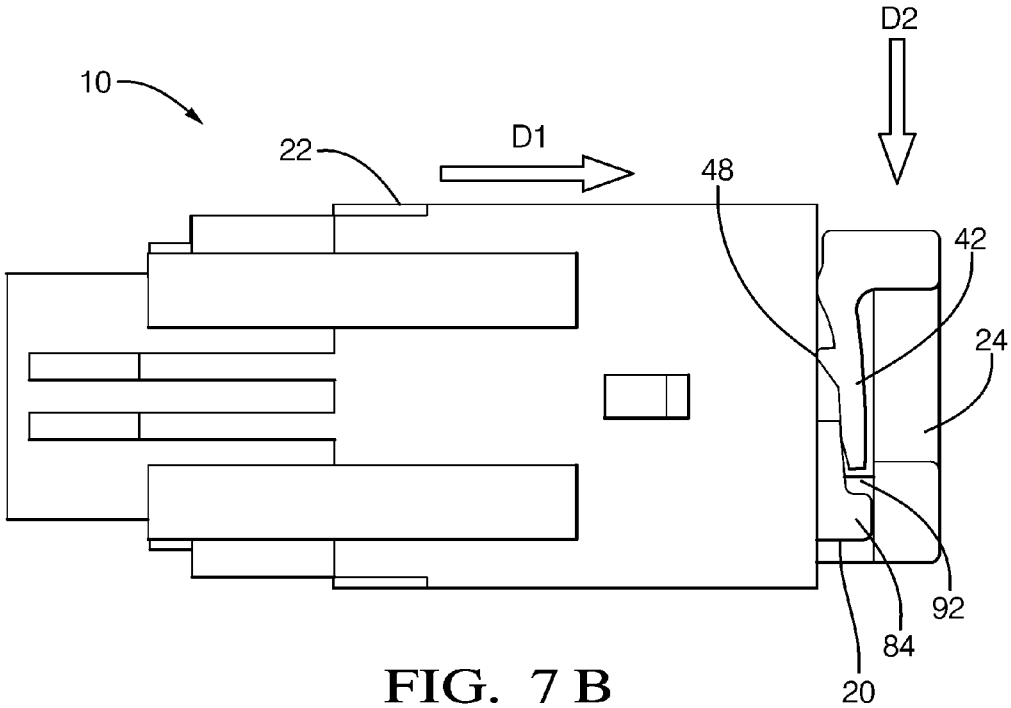
FIG. 7B is a bottom view of the connector assembly in a full-stage position.

FIGS. 7A-7B illustrate the second connector 22 being slid over the first connector 20 in the first direction D1 to establish a connection between the first and second connectors 20, 22. FIG. 7A is an illustration of the connector assembly 10 where the CPA device 24 has been urged out of the pre-stage position by actuation of the second connector 22 in the first direction D1 and into an intermediate position. FIG. 7B is an illustration of the connector assembly 10 where the CPA device 24 has been locked into a full-stage position.

FIG. 7A illustrates the connector assembly as the second connector 22 is slid over the first connector 22 in the first direction D1. In the intermediate position as shown in FIG. 7A, the shroud 28 of the second connector 22 makes contact with the mating detection feature 48 located on the flexible arm 42 of the CPA device 24. The shroud 28 is positioned to selectively contact the flexible arm 42 in the first direction D1 to urge the flexible arm 42 out of the pre-stage position (shown in FIG. 5C) and into the intermediate position shown in FIG. 7A. Specifically, the shroud 28 exerts a force in the first direction D1 on the flexible arm 42, causing the outer surface 49 of the flexible arm 42 to slide off the stopper surface 90 of the stopper feature 84. The flexible arm 42 is now in the intermediate position, where the flexible arm 42 is located in the recess 92 of the stopper feature 84. In the non-limiting embodiment as shown, the outer surface 92 of the flexible arm 42 includes a ramped surface 120. The ramped surface 120 facilitates the flexible arm 42 sliding off of the stopper surface 90. In the intermediate position, movement of the CPA device 24 in the second direction D2 is no longer restricted.

The CPA device 24 is then actuated in the second direction D2 by movement from the intermediate position shown in FIG. 7A into the full-stage position shown in FIG. 7B. In the full-stage position, the first and second connectors 20, 22 are connected together. Referring to FIG. 7B, the flexible arm 42 is urged further into the recess 92 of the stopper feature 84 in the full-stage position.

The CPA device 24 is actuated in the second direction D2 because the CPA device 24 has a reduced risk of inadvertently sliding from the pre-stage position into the full stage position when compared to some other types of connector assemblies. That is, some other types of connector assemblies actuate the CPA device into the full-stage position in the same direction as the actuation needed to mate the connectors together. This may result in the CPA device inadvertently locking into the full-stage position prematurely. In contrast, the CPA device 24 is actuated in the second direction D2, which is generally perpendicular to the first direction D1 which connects the first and second connectors 20, 22 together. As a result, the risk of inadvertently sliding the CPA device 24 into the full-stage position is reduced or eliminated.

Figure 8:
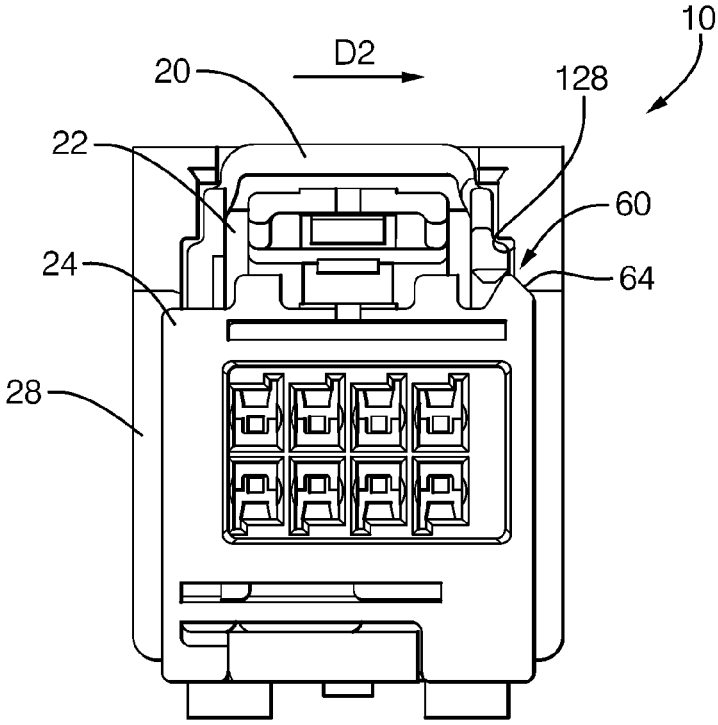
FIG. 8 is a front view of the connector assembly in the pre-stage position.

FIG. 8 is a frontal view of the connector assembly 10 in the full stage position. The CPA device 24 is slid from the pre-stage position into the full-stage position until the chamfered edge 64 of the protuberance 60 abuts against an inner surface 128 of the shroud 28 in the full-stage position. The contact between the chamfered edge 64 and the inner surface 128 of the shroud 28 positions the CPA device 24 in the full-stage position.

Figure 9:
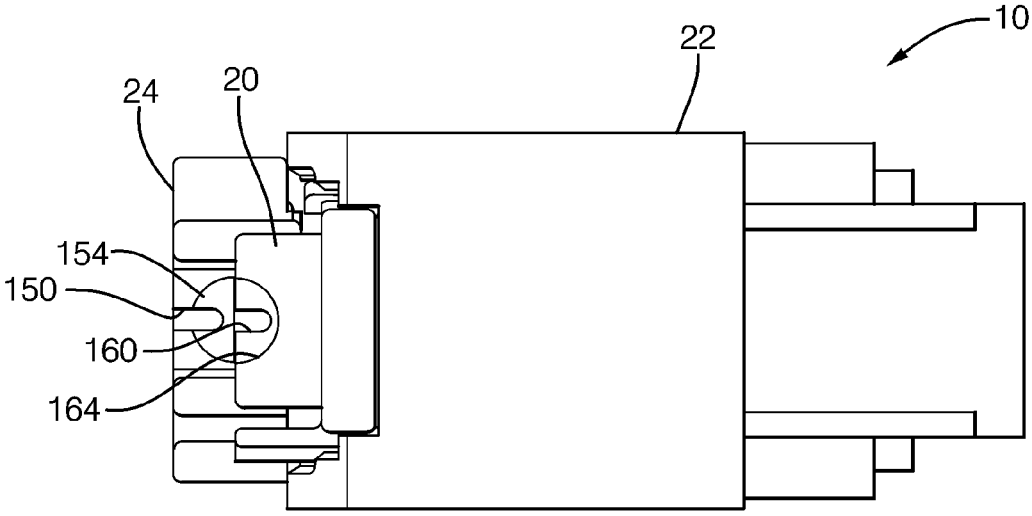
FIG. 9 is a top view of the connector assembly in the pre-stage position.

FIG. 9 is a top view of the connector assembly 10 in the full stage position. Both the CPA device 24 and the first connector 20 have visual feedback indicators to indicate to an operator during assembly if the CPA device 24 is in the full-stage position. In the non-limiting embodiment as shown, the CPA device 24 includes a first CPA indicator 150 that is a notch created within the CPA device 24 as well as a second CPA indicator 154 that is a semi-circular indentation. The first connector 20 includes a first connector indicator 160 that is a notch created within the first connector 20 as well as a second connector indicator 164 that is a semi-circular indentation. As the CPA device 24 is slid in the direction D2 and into the full-stage position, the first CPA indicator 150 axially aligns with the first connector indicator 160. The second CPA indicator 154 aligns with the second connector indicator 164 to create a circular indentation between the CPA device 24 and the first connector 20.

Figure 10:
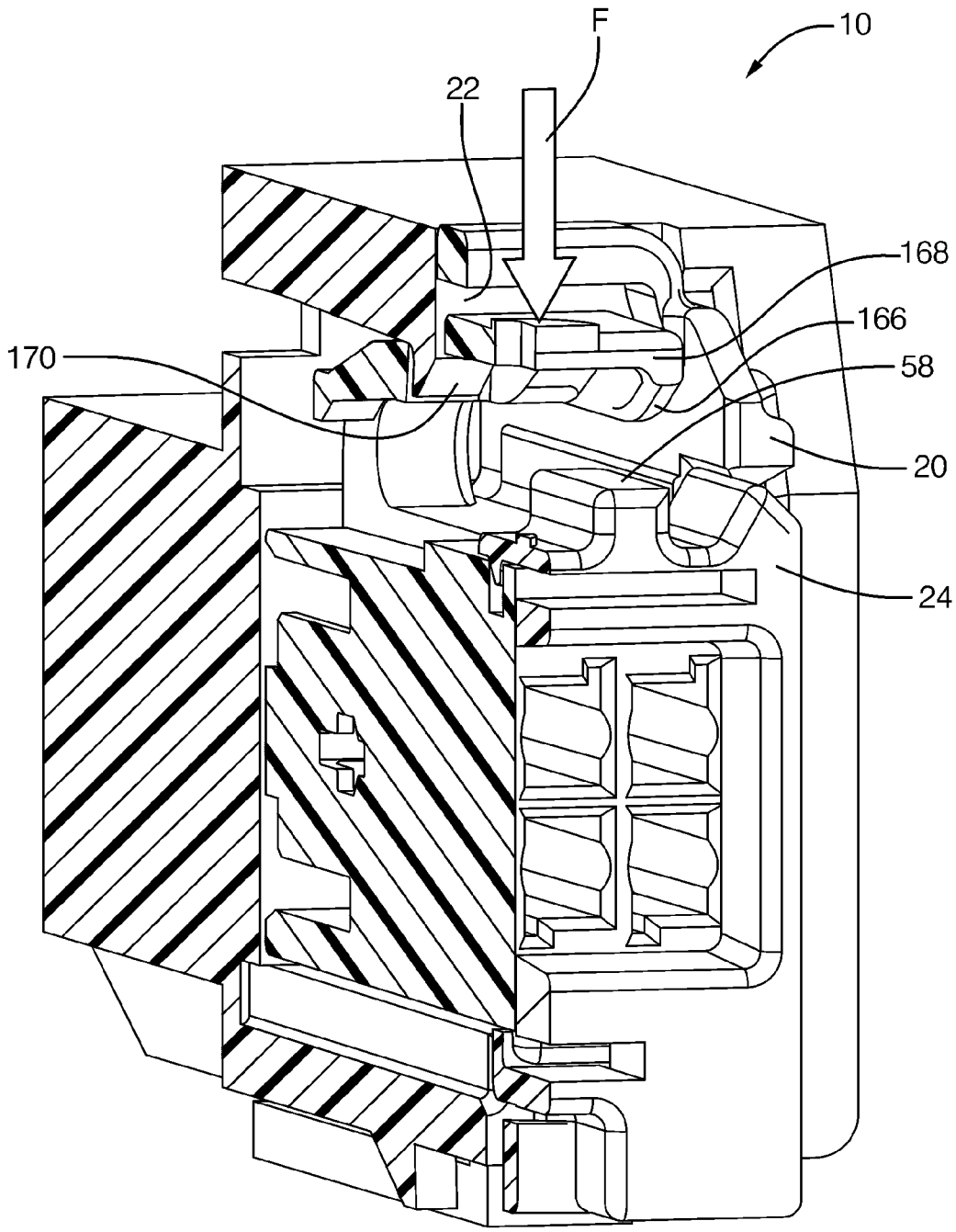
FIG. 10 is a perspective illustration of a cross section of the connector assembly.

The CPA device 24 reduces or prevents the occurrence of disconnection between the connectors 20, 22 when in the full-stage position. FIG. 10 is a cross-sectioned view of the connector assembly 10 in the full-stage position. The top surface 66 of the raised projection 58 of the CPA device 24 contacts a connector lock surface 166 located on the first connector 20. The contact between the top surface 66 of the CPA device 24 and the connector lock surface 166 generally prevents a first connector lock 168 located on the first connector 20 from releasing an over-lock feature 170 located on the second connector 22. Specially, a downwards force F is exerted on the first connector lock 168 to release the first connector 20 from the over-lock feature 170 on the second connector 22. The top surface 66 of the CPA device 24 holds the first connector lock 168 in place such that the first connector lock 168 is unable to release from the over-lock feature when the downwards force F is exerted.

Figure 11:
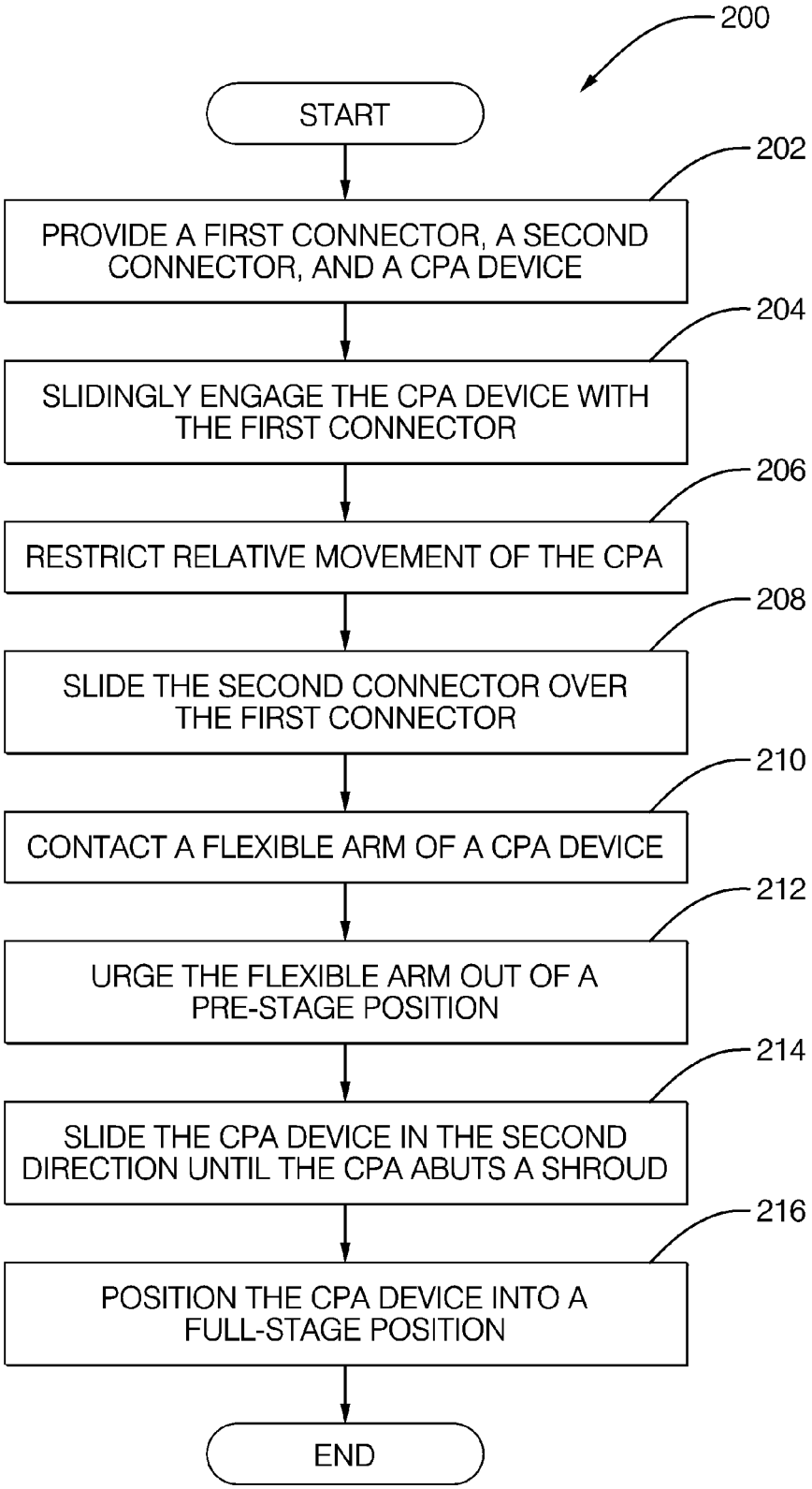
FIG. 11 is a process flow diagram for assembling the connector assembly in accordance with one aspect of the invention.

A method of assembling the connector assembly 10 will now be explained. Referring to FIG. 11, an exemplary process flow diagram illustrating an exemplary process of assembling the connector assembly 10 is generally indicated by reference number 200. Process 200 begins at step 202, where a first connector 20, a second connector 22, and a CPA device 24 are provided. Referring generally to FIGS. 1-2, the second connector 22 includes a shroud 28 that slides over the first connector 20 in a first direction D1. The first connector 20 includes a first end 32 and a second end 34, where the CPA device is slidingly engaged with the second end 34 of the first connector 20 in a second direction D2. Method 200 may then proceed to step 204.

In step 204, the CPA device 24 slidingly engages with a first end 34 of the first connector 20 in the second direction D2. FIGS. 3A-3B illustrate a back side 40 of the CPA device 24 that engages with the first connector 20. The back side 40 of the CPA device 24 includes a rail 44 and a lip 46. The rail 44 and the lip 46 are structural members that are used to slidingly engage the CPA 24 with the first connector 20 in the second direction D2. FIG. 4 illustrates of a front side 70 of the first connector 20, where the front side 70 slidingly engages with the back side 40 of the CPA device 24. The front side of the first connector 20 includes a guide 74 and a slot 76. The rail 44 of the CPA device 24 is configured to receive the guide 74, and the slot 76 is configured to receive the lip 46 of the CPA device. Method 200 may then proceed to step 206.

In step 206, relative movement of the CPA device 24 to the first connector 20 in the second direction D2 is restricted. Specifically, referring to FIG. 5C, a flexible arm 42 of the CPA device 24 abuts against a stopper surface 90 of a stopper feature 84 of the first connector 20. The stopper surface 90 abuts against an outer surface 49 of the flexible arm 42 to hold the CPA device 24 in a pre-stage position. When the CPA device 24 is in the pre-stage position, the first connector 20 and the second connector 24 can mate and connect with one another. Method 200 may then proceed to step 208.

In step 208, the second connector 22 is slid over the first connector 20 in a first direction. Referring to FIGS. 1-2, the first direction D1 is generally perpendicular to the second direction D2. Method 200 may then proceed to step 210.

In step 210, the shroud 28 of the second connector 22 contacts the flexible arm 42 of the CPA device 24. Referring to FIG. 7A, as the second connector 22 is actuated in the first direction D1, the shroud 28 makes contact with a mating detection feature 48 located on the flexible arm 42 of the CPA device 24. Method 200 may then proceed to step 212.

In step 212, the flexible arm 42 is urged out of the pre-stage position (shown in FIG. 5C) and into an intermediate position (shown in FIG. 7A). Referring to FIG. 5C, the shroud 28 exerts a force in the first direction D1 on the flexible arm 42, causing an outer surface 94 of the flexible arm 42 to slide off a stopper surface 90 of the stopper feature 84. Referring to FIG. 7A, the flexible arm 42 is now in an intermediate position, where the flexible arm 42 is located in a recess 92 of the stopper feature 84. In the intermediate position, movement of the CPA device 24 in the second direction D2 is no longer restricted. Method 200 may then proceed to step 214.

In step 214, the CPA device 24 is then slid in the second direction D2 until a chamfered edge 64 of a protuberance 60 of the CPA device 24 abuts against an inner surface 128 of the shroud 28. As shown in FIG. 8, the chamfered edge 64 acts as a stop, where the CPA device 24 is slid from the pre-stage position into the full-stage position (FIG. 8) until the chamfered edge 64 of the protuberance 60 abuts against an inner surface 128 of the shroud 28 in the full-stage position (FIG. 8). Method 200 may then proceed to step 216.

In step 216, the CPA device 24 is positioned into the full-stage position by abutment of the chamfered edge 64 of the protuberance 60 against the inner surface of the shroud. The CPA device 24 reduces or prevents the occurrence of disconnection between the connectors 20, 22 when in the full-stage position. Method 200 may then terminate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A connector assembly, comprising:

a first connector having a stopper feature, a first end and a second end that generally opposes the first end, the stopper feature having a recess provided therein and a stopper surface;

a second connector received by the first connector, the second connector including a shroud that slides over the first end of the first connector in a first direction;

a connector position assurance (CPA) device slidingly engaged with the second end of the first connector in a second direction that is generally perpendicular to the first direction, the CPA device having a flexible arm that is selectively deformable, the flexible arm abutting against the stopper surface to restrict relative movement of the CPA device in the second direction in a pre-stage position, and the flexible arm located within the recess of the stopper feature in an intermediate position, the shroud positioned to selectively contact the flexible arm in the first direction for urging the flexible arm from the pre-stage position into the intermediate position.

2. The connector assembly of claim 1, wherein the flexible arm includes a mating detection feature that is a raised surface located along an outer surface of the flexible arm, wherein the mating detection feature being configured to contact the shroud of the second connector in the intermediate position.

3. The connector assembly of claim 1, wherein the CPA device includes a raised protuberance positioned along an edge of the CPA device, and the raised protuberance abuts against the shroud to limit movement of the CPA device in the second direction in a full-stage position.

4. The connector assembly of claim 3, wherein the first connector and the second connector are connected to one another in the full-stage position.

5. The connector assembly of claim 3, wherein the first connector includes a first visual feedback indicator and the CPA device includes a CPA visual feedback indicator, and the first visual feedback indicator aligns with the CPA visual feedback indicator to indicate the connector assembly is in the full-stage position.

6. The connector assembly of claim 1, wherein the CPA device includes a rail and the first connector includes a guide that corresponds with the rail, the rail slidingly engagable with the guide in the second direction.

7. The connector assembly of claim 6, wherein the CPA device includes a lip and the first connector includes a slot that corresponds with the lip, the lip slidingly engageable with the slot in the second direction.

8. The connector assembly of claim 1, wherein the first connector includes a wall having an inner wall surface and the CPA device includes a raised projection located along a top surface of the CPA, the raised projection engageable with the inner wall surface of the first connector to position the CPA device in the pre-stage position.

9. The connector assembly of claim 1, wherein the first connector and the second connector are configurable to mate and connect with one another in the pre-stage position.

10. The connector assembly of claim 1, wherein the first connector is a female connector and the second connector is a male connector.

11. A method of connecting a first connector to a second connector using a CPA device, comprising:

providing the first connector, the second connector, and the CPA device, the first connector having a stopper feature, a first end and a second end that generally opposes the first end, the second connector including a shroud that slidingly engages over the first connector in a first direction towards the second end;

slidingly engaging the CPA device with the second end of the first connector in a second direction that is generally perpendicular to the first direction;

restricting relative movement of the CPA device in the second direction, a flexible arm of the CPA device abutting against a stopper surface of the stopper feature to restrict relative movement of the CPA device in the second direction, the CPA device being a in pre-stage position;

sliding the second connector over the first connector in the first direction;

contacting the flexible arm with the shroud as the second connector is slid in the first direction; and urging the flexible arm out of the pre-stage position and into an intermediate position, the intermediate position having the flexible arm located in a recess located within the stopper feature.

12. The method of claim 11, including sliding the CPA device in the second direction after the flexible arm is urged in the intermediate position.

13. The method of claim 12, including limiting movement of the CPA device in the second direction by providing a raised protuberance positioned along an edge of the CPA device, and abutting the raised protuberance with an inner surface of the shroud.

14. The method of claim 13, including positioning the CPA device into a full-stage position by abutting the raised protuberance against the inner surface of the shroud.

15. The method of claim 11, including contacting the shroud as the second connector is slid in the first direction with a mating detection feature that is a raised surface located on the flexible arm.

16. The method of claim 11, including positioning the CPA device in the pre-stage position by engaging an inner wall surface of a wall of the first connector with a raised projection located along a top surface of the CPA.

17. A connector assembly, comprising:

a first connector having a stopper feature, a first end and a second end that generally opposes the first end, the stopper feature having a recess provided therein and a stopper surface;

a second connector received by the first connector, the second connector including a shroud having an inner surface, the shroud slidable over the first end of the first connector in a first direction;

a connector position assurance (CPA) device slidingly engaged with the second end of the first connector in a second direction that is generally perpendicular to the first direction, the CPA device having an edge, a flexible arm that is selectively deformable, and a raised protuberance, the raised protuberance positioned along the edge of the CPA device, the flexible arm abutting against the stopper surface to restrict relative movement of the CPA device in the second direction in a pre-stage position, the flexible arm located within the recess of the stopper feature in an intermediate position, the shroud positioned to selectively contact the flexible arm in the first direction for urging the flexible arm from the pre-stage position into the intermediate position, and the raised protuberance abutting against the shroud to limit movement of the CPA device in the second direction in a full-stage position.

18. The connector assembly of claim 17, wherein the flexible arm includes a mating detection feature that is a raised surface located along an outer surface of the flexible arm, the mating detection feature being configured to contact the shroud of the second connector in the intermediate position.

19. The connector assembly of claim 17, wherein the first connector includes a wall having an inner wall surface and the CPA device includes a raised projection located along a top surface of the CPA, the raised projection engageable with the inner wall surface of the first connector to position the CPA device in the pre-stage position.

20. The connector assembly of claim 17, wherein the first connector is a female connector and the second connector is a male connector.

* * * * *